US005624305A

United States Patent [19]

Brown

[11] Patent Number: 5,624,305

[45] Date of Patent: Apr. 29, 1997

[54] POLE MOUNTED VACUUM SANDER

[76] Inventor: Geoffrey P. Brown, 1923 West 41st Avenue, Vancouver, British Columbia, Canada, V6M 1Y5

[21] Appl. No.: 594,084

[22] Filed: Jan. 30, 1996

[51] Int. Cl.[6] ..... B24B 23/00

[52] U.S. Cl. ..... 451/354; 451/344; 16/337

[58] Field of Search ..... 451/354, 344, 451/456, 527, 530, 538; 16/337, 110 R, 111 R

[56] References Cited

U.S. PATENT DOCUMENTS

| | | | |
|---|---|---|---|
| 2,048,273 | 7/1936 | Linquist | 15/416 |
| 2,283,428 | 5/1942 | Elis | 15/416 |
| 3,039,463 | 6/1962 | Dickey Jr. et al. | 604/119 |
| 3,071,399 | 1/1963 | Jepson et al. | 15/354 |
| 3,332,101 | 7/1967 | Leinfelt et al. | 91/253 |
| 3,517,669 | 6/1970 | Bono et al. | 604/119 |
| 3,527,111 | 9/1970 | Zimmerman | 74/110 |
| 3,754,354 | 8/1973 | Franlinna | 451/167 |
| 3,785,092 | 1/1974 | Hutchins | 451/357 |
| 3,834,388 | 9/1974 | Sauer | 427/96 |
| 4,062,152 | 12/1977 | Mehrer | 451/344 |
| 4,184,291 | 1/1980 | Marton | 451/344 |
| 4,202,140 | 5/1980 | Alessio | 451/527 |
| 4,616,449 | 10/1986 | Marton | 451/456 |
| 4,631,778 | 12/1986 | Kocon et al. | 16/337 |
| 4,680,895 | 7/1987 | Roestenberg | 451/359 |
| 4,759,155 | 7/1988 | Shaw | 451/524 |
| 4,779,385 | 10/1988 | Reiter | 451/354 |
| 4,829,719 | 5/1989 | Braselton | 451/354 |
| 4,937,984 | 7/1990 | Taranto | 451/524 |
| 4,964,243 | 10/1990 | Reiter | 451/354 |
| 5,007,206 | 4/1991 | Paterson | 451/344 |
| 5,036,627 | 8/1991 | Walters | 451/354 |
| 5,283,988 | 2/1994 | Brown | 451/524 |
| 5,428,865 | 7/1995 | Yarbrough | 451/354 |

*Primary Examiner*—Bruce M. Kisliuk
*Assistant Examiner*—Andrew Weinberg
*Attorney, Agent, or Firm*—Merchant, Gould, Smith, Edell, Welter & Schmidt, P.A.

[57] ABSTRACT

Current pole mounted vacuum sanders have universal connections between the pole and sander which permit the sanding pad to lift off the sanding surface when pressure is applied. The present invention provides a universal connection between the pole and base of the vacuum hand sanding device which allows the head to be semi-locked into position when the pole is angled to the working surface to prevent the pad lifting from the surface.

10 Claims, 6 Drawing Sheets

POLE MOUNTED VACUUM SANDER

BACKGROUND OF THE INVENTION

The invention relates to tools for manual sanding and more particularly to a pole-mounted sanding device provided with a vacuum connection for drawing off the dust created by the sanding action.

The sanding of wood, drywall or plaster is typically accomplished using a sanding block which is handheld and to which sheets of sand paper can be removably attached. The dust generated by the sanding action, particularly in the case of drywall, falls freely in the work area and therefore requires subsequent cleanup.

Various devices have been designed to provide a vacuum connection to the sander head to pick up the dust generated by the sanding action in the vicinity of the sander head. The present applicant's U.S. Pat. No. 5,283,988 issued Feb. 8, 1994 discloses a vacuum sander of the type comprising means for connecting a source of vacuum, a base for attaching a back-up pad and means for releasably attaching an abrasive, air-permeable sheet. In that device, the back-up pad was designed with a raised perimeter provided with a plurality of grooves extending from the outer edge to an inner chamber, which improved the ability of the device to pick up dust around the edges of the sanding surface.

Mehrer U.S. Pat. No. 4,062,152, discloses a sander which is connected to a vacuum source by a hollow tubular handle. A porous abrasive sheet is mounted on the front surface of a backing plate which has a number of bores which provide an air passageway from the abrasive sheet to a manifold which in turn communicates with the tubular handle by a hollow sleeve universally mounted on the sander body. A problem with pole mounted vacuum sanders however is that one longitudinal edge of the sander head tends to lift off the wall as the head is moved up or down, causing it to lose suction and contact with the wall.

There remains a need therefore for a pole mounted vacuum sander which has a universal joint connection between the pole and the sander head which is secure enough to prevent the sander head from losing contact with the surface being sanded during use.

SUMMARY OF THE INVENTION

The present invention provides a pole mounted sanding device for sanding a working surface, where the device is of the type comprising a base for attaching a back-up pad, means for releasably attaching an abrasive sheet to the base and universal means for connecting the pole to the base. The universal joint means includes a contact surface on the pole and a camming surface mounted on said base whereby the pole can be pivoted between a first position wherein the pole is perpendicular to the broad surface of the back-up pad and the contact surface is spaced from the camming surface to a second intermediate position where the contact surface bears against the camming surface to a third position where the pole is angled to the broad surface of the back-up pad and the contact surface is spaced from the camming surface or bears against the camming surface with less force than in the intermediate position. Preferably the device is of the type comprising means for connecting a source of vacuum to the base and the abrasive sheet is air permeable.

BRIEF DESCRIPTION OF THE DRAWINGS

In drawings which illustrate a preferred embodiment of the invention.

DETAILED DESCRIPTION OF A PREFERRED EMBODIMENT

Figure 6:
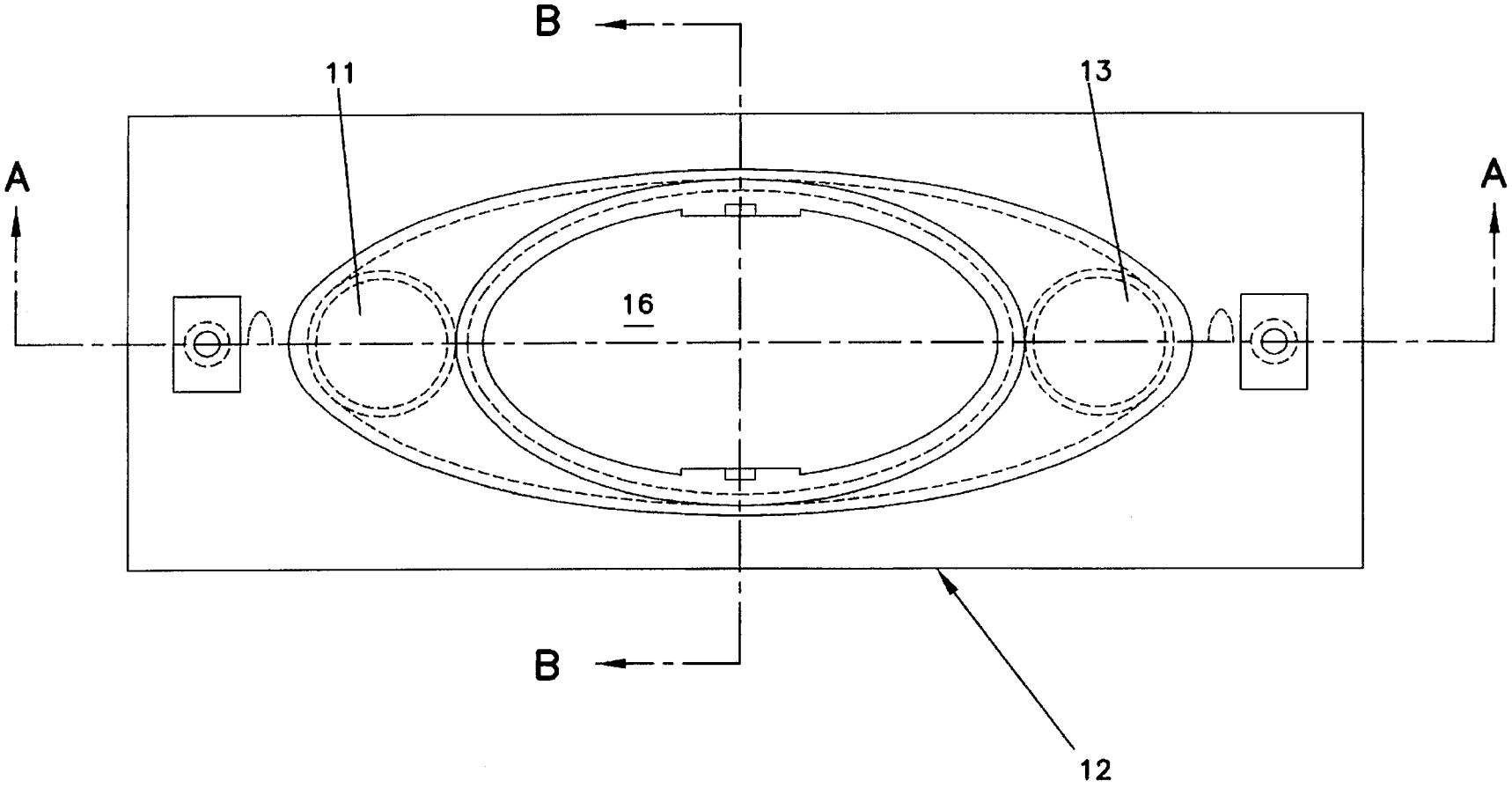
FIG. 6 is a top view of the invention shown in FIG. 1 with the flexible boot and universal assembly removed and air passages shown in dotted outline.
Figure 7:
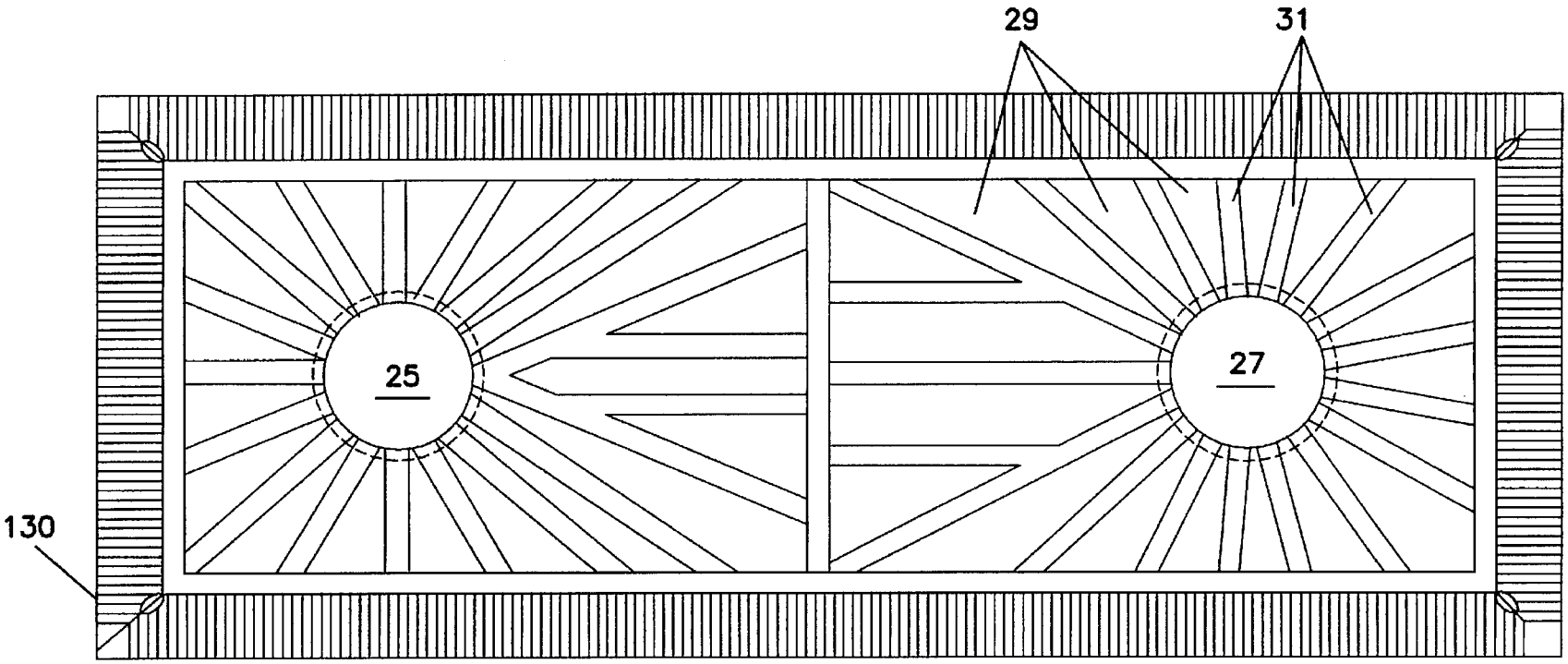
FIG. 7 is a bottom view of the back-up pad.

The pole mounted vacuum sander of the invention is designated generally by reference numeral 10. It comprises a base member 12 of moulded plastic which has a hollow, upwardly extending air chamber section 14 with central aperture 16, the periphery 18 of which forms a lip to receive the edge of a flexible rubber boot 17. Base member 12 is provided with two holes 11 and 13 (FIG. 6) which communicate with the interior 15 of chamber 14. Base 12 is provided at either end thereof with a clamp 19, consisting of clamping bar 20, wing nuts 22 and bolts 24 which are of standard construction, for releasably securing a sheet of abrasive, air-permeable mesh (not shown) of the type sold by the 3M Company for use as a gyproc filler mesh sanding pad. Fixed to the bottom of base 12 is a moulded neoprene rubber backing pad 23, also provided with two holes 25 and 27 (FIG. 7) which are co-extensive with holes 11 and 13 in base 12. Pad 23, as disclosed in applicant's U.S. Pat. No. 5,283,988, has a series of raised support ridges 29 and raised perimeter 130 which extend upwardly from the inner recessed surface 31 of pad 23. Perimeter 130 is provided with regularly spaced ridges 135 and grooves 137 forming a rippled surface.

Pipe connector 30 is a hollow tube of moulded plastic provided with threads 32 which receive the threaded end of a hollow pole (not shown) which in turn is connected to a standard shop vacuum hose. The hollow interior 35 of pipe connector 30 is also tapered to directly receive a vacuum hose and communicates along the hollow central axis 37 into the hollow chamber 19 formed under boot 17. Pipe connector 30 has an aperture 34, in a section of the connector 31 of reduced diameter, opening to the interior of pipe connector 30. A series of ratchet ridges 33 are provided along the upper edge of section 31 and an annular collar 36 (not shown in FIG. 2 through 6) having a cutout rotates in section 31. The interior surface of collar 36 also has a series of ridges so that enough friction exists between ridges 33 and collar 36 to retain collar 36 in a set rotational position until an appropriate rotational force is applied. In this way the flow of air through aperture 34 can be regulated by rotation of collar 36. When a source of vacuum is connected to pipe connector 30, the degree of vacuum applied to the base of the sander is thus regulated by rotating collar 36, permitting the amount of suction applied to the wall to be varied in the event that the pad is sticking to the wall due to overly great suction, for example.

Pipe connector 30 also is provided with a groove 40 which receives the upper edge of flexible rubber boot 17. Pipe connector 30 is connected to base 12 by a universal connection as follows. The lower end of pipe connector 30 is bifurcated, having two parallel extensions 42 which pivot on rivet 44 which extends through T-element 48. T-element 48 is connected to a cylindrical tube 50 which similarly pivots on rivet 52 which extends through and is secured in base 12.

Figure 1:
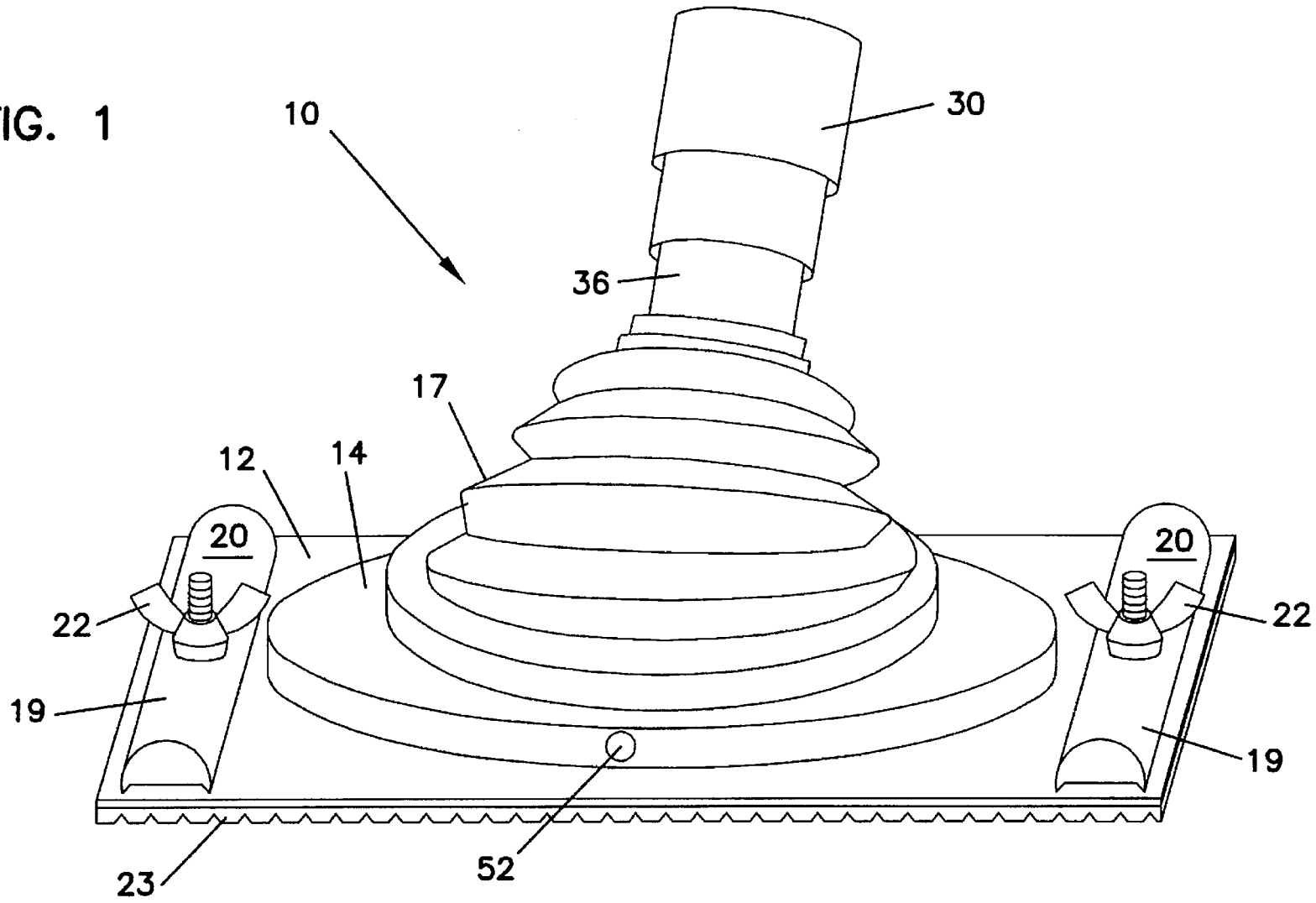
FIG. 1 is a perspective view of the invention.
Figure 3:
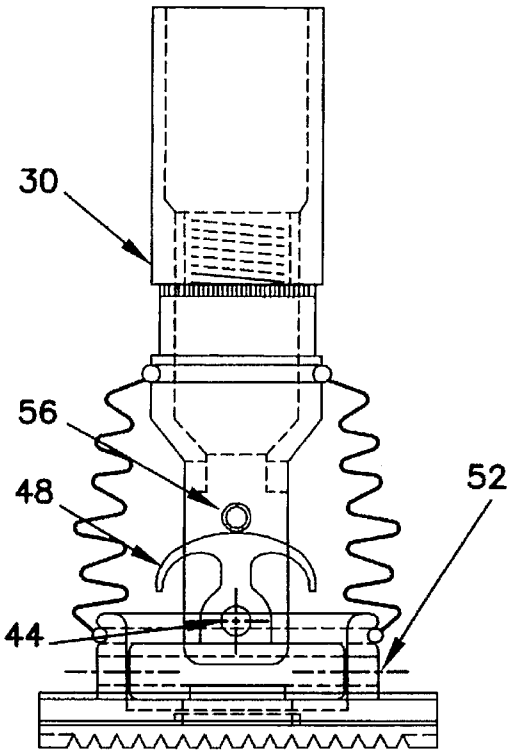
FIG. 3 is a partial cross-section of the invention taken along lines B—B of FIG. 6.
Figure 2:
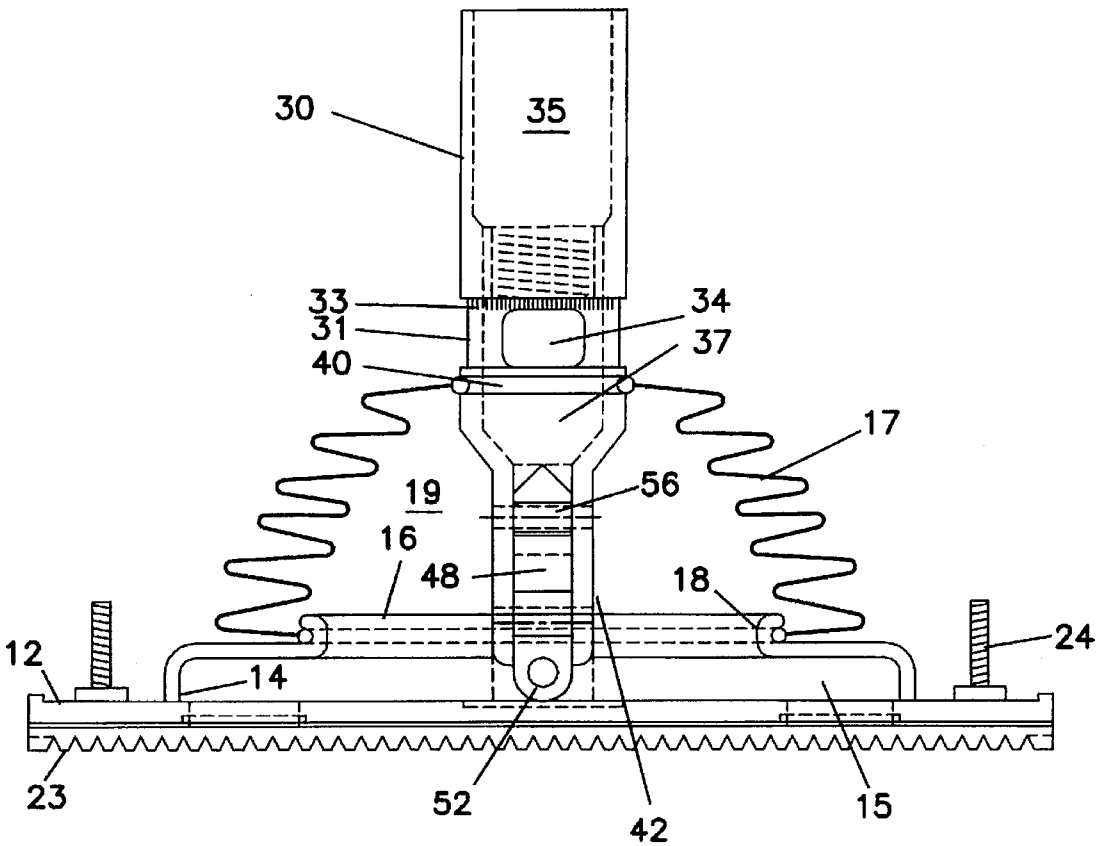
FIG. 2 is a partial cross-section of the invention taken along lines A—A of FIG. 6, with clamping bars removed.
Figure 4:
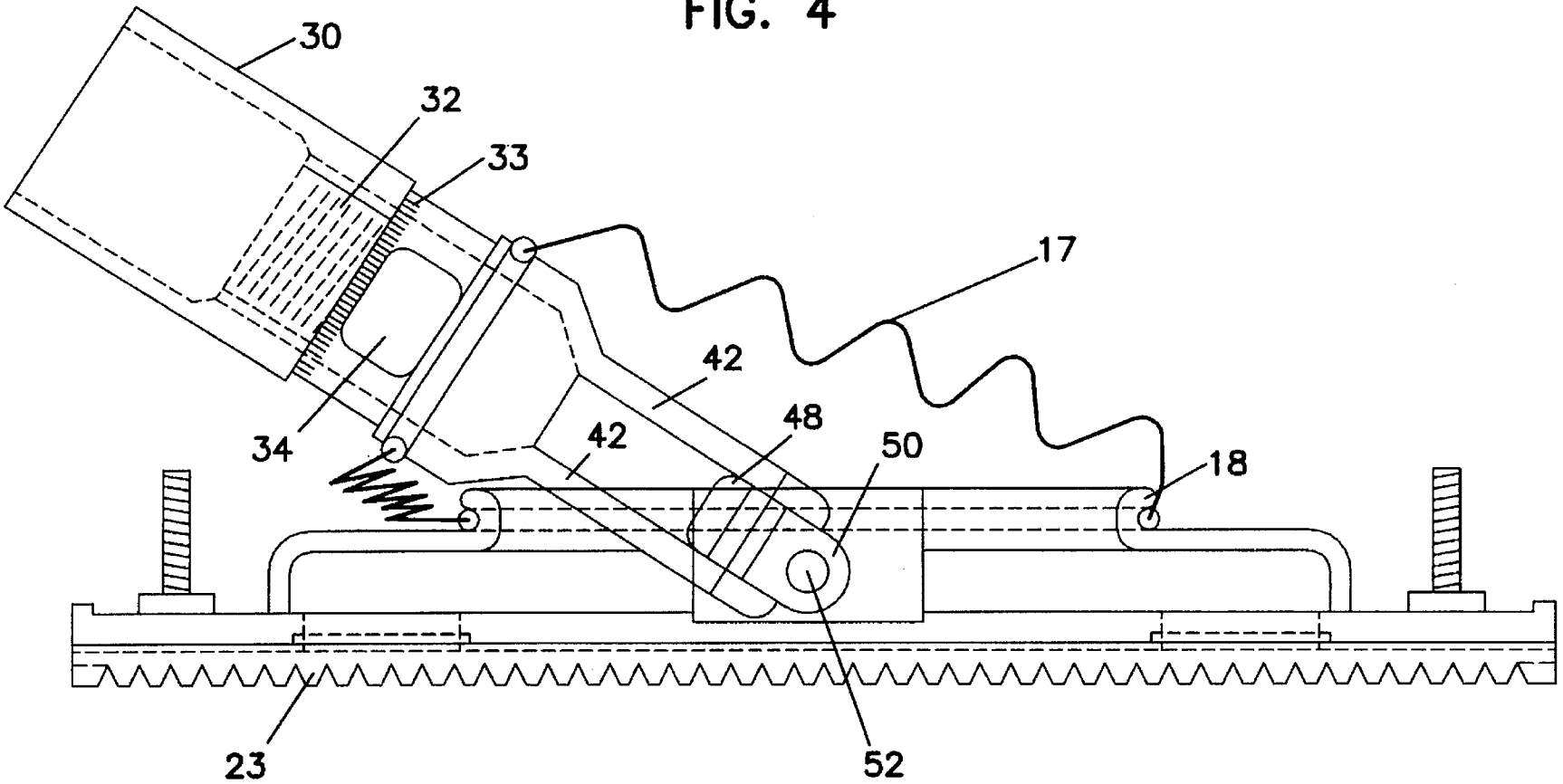
FIG. 4 is a cross-sectional view as in FIG. 2, with the pole mount angled to one side.
Figure 5:
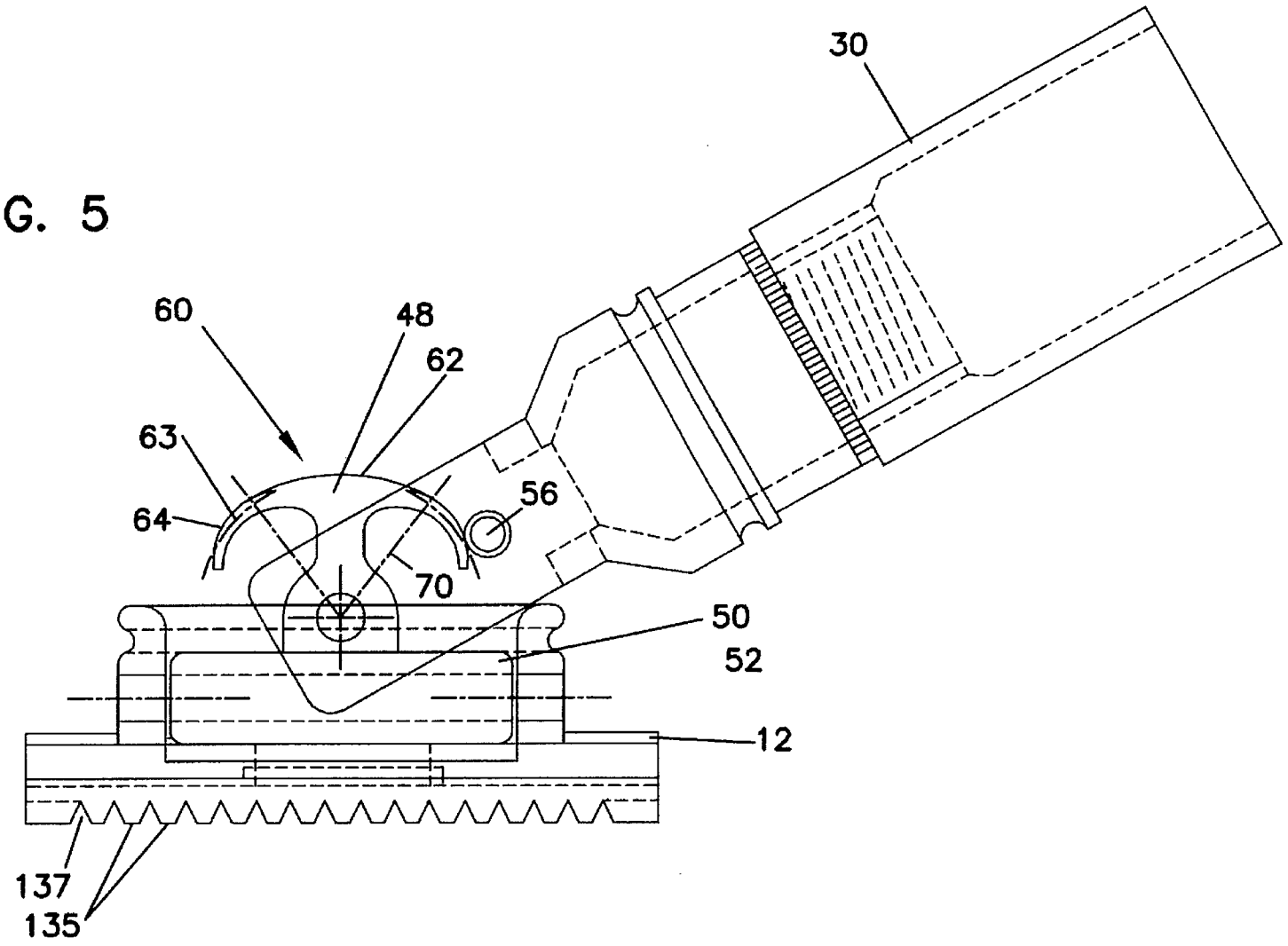
FIG. 5 is a side view of the invention shown in FIG. 1 with the flexible boot removed to illustrate the operation of the camming element.

As illustrated in FIG. 5, T element 48 has an upper camming surface 60, the central surface portion 62 of which follows a circular arc 63, but the outer surface portions 64 of which extends outwardly beyond the arc of radius 63. Roller 56 is mounted between extensions 42 for rotation on pin 58 and is positioned so that when pipe connector 30 is in the position shown in FIG. 2, roller 56 clears surface portion 62 without contact, but in the position shown in FIG. 5, roller 56 bears tightly against surface portion 64. Due to the shape and material of T-element 48, and cut-outs 70, and the shape of surface portions 64, the ends of T element 48 give slightly under pressure and once the roller is in the position shown in FIG. 5 it tends to bind in that position and increased rotational force is required to move it out of that position to a raised position.

In operation, a pole attached to a source of vacuum is secured to pipe connector 30 and vacuum sander 10 is raised into position on a wall, for example. The pole and attached pipe connector 30 are then pivoted to the position shown in FIG. 5 to tighten the pole into position and the sander can then be operated on the wall without undue releasing from the wall surface. To permit a freer universal movement of the sander 10, the pole is rotated upwardly to bring roller 56 out of contact with T element 48.

As will be apparent to those skilled in the art, various modifications and adaptations of the structure above described may be made without departing from the spirit of the invention, the scope of which is to be construed in accordance with the accompanying claims.

I claim:

1. A pole mounted sanding device for sanding a working surface, said device comprising a pole receiving section, a base for attaching a back-up pad, said backing pad having a broad surface and means for releasably attaching an abrasive sheet to said back-up pad, said pole receiving section connected to said base by universal joint means, wherein said universal joint means comprises a contact surface on said pole and a camming surface mounted on said base whereby said pole is adapted to be pivoted between a first position wherein said pole is perpendicular to the broad surface of said back-up pad and said contact surface is spaced from said camming surface to a second intermediate position where said contact surface bears against said camming surface to a third position where said pole is angled to said broad surface of said back-up pad and said contact surface is spaced from said camming surface or bears against said camming surface with less force than in said intermediate position.

2. The device of claim 1 further comprising means for connecting a source of vacuum to said base and wherein said abrasive sheet is air-permeable.

3. The device of claim 1 wherein said contact surface comprises roller means rotatably mounted on said pole connection means.

4. The device of claim 1 wherein said camming surface is pivotally mounted on said base.

5. The device of claim 1 wherein said camming surface has a central area and two adjoining surfaces wherein said contact surface bears against said camming surface in said intermediate position.

6. The device of claim 2 wherein said back-up pad comprises two apertures communicating with said vacuum source.

7. The device of claim 6 wherein said back-up pad comprises a lower surface comprising a raised perimeter provided with a plurality of grooves and a plurality of support surfaces extending downwardly a distance equal to the height of said raised perimeter.

8. The device of claim 1 wherein said pole receiving section is provided with a first aperture communicating between the interior of said pole receiving section and the exterior of said device and means for variably allowing air from the exterior of said device to enter into the interior of said pole receiving section.

9. The device of claim 8 wherein said means for varying comprises a collar having a second aperture, whereby said second aperture is rotatable into and out of alignment with said first aperture.

10. The device of claim 2 wherein said back-up pad comprises a raised outer perimeter forming an inner edge and an outer edge, and a plurality of passageways provided across said perimeter to communicate between said inner and outer edge, said inner edge thereby forming with said working surface a hollow chamber which is the primary negative pressure storage chamber of the device, a sheet-supporting lower surface, an aperture formed in said lower surface for communicating with said vacuum source, and a plurality of grooves formed in said sheet-supporting lower surface and communicating between said aperture and said inner edge of said outer perimeter, said grooves thereby forming with said working surface a plurality of passageways between said working surface and said outer perimeter of said back-up pad, said passageways providing air communication between said aperture and said inner edge of said outer perimeter.

* * * * *